United States Patent [19]

Ohno et al.

[11] Patent Number: 4,615,612

[45] Date of Patent: Oct. 7, 1986

[54] COLOR IMAGE FORMING APPARATUS

[75] Inventors: Akio Ohno; Yasushi Murayama; Kazuhiko Hirooka; Kimiyoshi Hayashi, all of Tokyo, Japan

[73] Assignee: Canon Kabushiki Kaisha, Tokyo, Japan

[21] Appl. No.: 739,838

[22] Filed: May 31, 1985

[30] Foreign Application Priority Data

Jun. 6, 1984 [JP] Japan ..... 59-116159

[51] Int. Cl.[4] ..... G03G 15/06

[52] U.S. Cl. ..... 355/14 D; 355/4

[58] Field of Search ..... 355/14 D, 4, 3 DD, 10

[56] References Cited

FOREIGN PATENT DOCUMENTS 2850997 5/1979 Fed. Rep. of Germany ..... 355/4

0111555 12/1982 Japan ..... 355/4

*Primary Examiner*—R. L. Moses

*Attorney, Agent, or Firm*—Fitzpatrick, Cella, Harper & Scinto

[57] ABSTRACT

A color image forming apparatus wherein a plurality of developing devices or units are supported on a supporting member or turret which is rotatable to revolve the developing devices to move a desired developing device to a developing station where the developing operation is effected with the desired one of the developing devices so that a color image is formed. The position of the developing device is detected, and the detected position is compared with a datum of a target movement scheme predetermined for the developing apparatus. A driving motor for the apparatus is controlled to correct the difference therebetween which is the result of the comparison.

5 Claims, 9 Drawing Figures

COLOR IMAGE FORMING APPARATUS

BACKGROUND OF THE INVENTION

The present invention relates to a color image forming apparatus such as a color electrophotographic copying apparatus for forming a multi-color image or a full-color image and a color recording apparatus constituting an output station of a laser beam printer, a computer, a facsimile machine or the like.

Taking an electrophotographic copying apparatus as an example of a color image forming apparatus, it has been proposed that the apparatus comprises a photosensitive drum functioning as a latent image bearing member and a plurality of developing devices disposed around the photosensitive drum, the developing devices containing different colors of developing agents (U.S. Pat. No. 3,854,449), and that a plurality of the developing devices are supported on a supporting member or turret which is rotatable to revolve the developing devices so that a desired one of them can be moved to oppose the photosensitive drum at a developing station (U.S. Pat. No. 3,987,756).

The latter type is advantageous in that only one of the developing devices is opposed to the image bearing member whereby the peripheral length of the latent image bearing member is minimized.

In the apparatus wherein one of the developing devices is revolved by rotating the supporting member to the developing station, it is desired that the developing devices are moved or interchanged among themselves at a high speed and accurately.

SUMMARY OF THE INVENTION

Accordingly, it is a principal object of the present invention to provide a color image forming apparatus wherein the developing devices can be interchanged at a high speed and accurately.

It is another object of the present invention to provide a color image forming apparatus wherein the developing devices can start moving and can stop smoothly.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
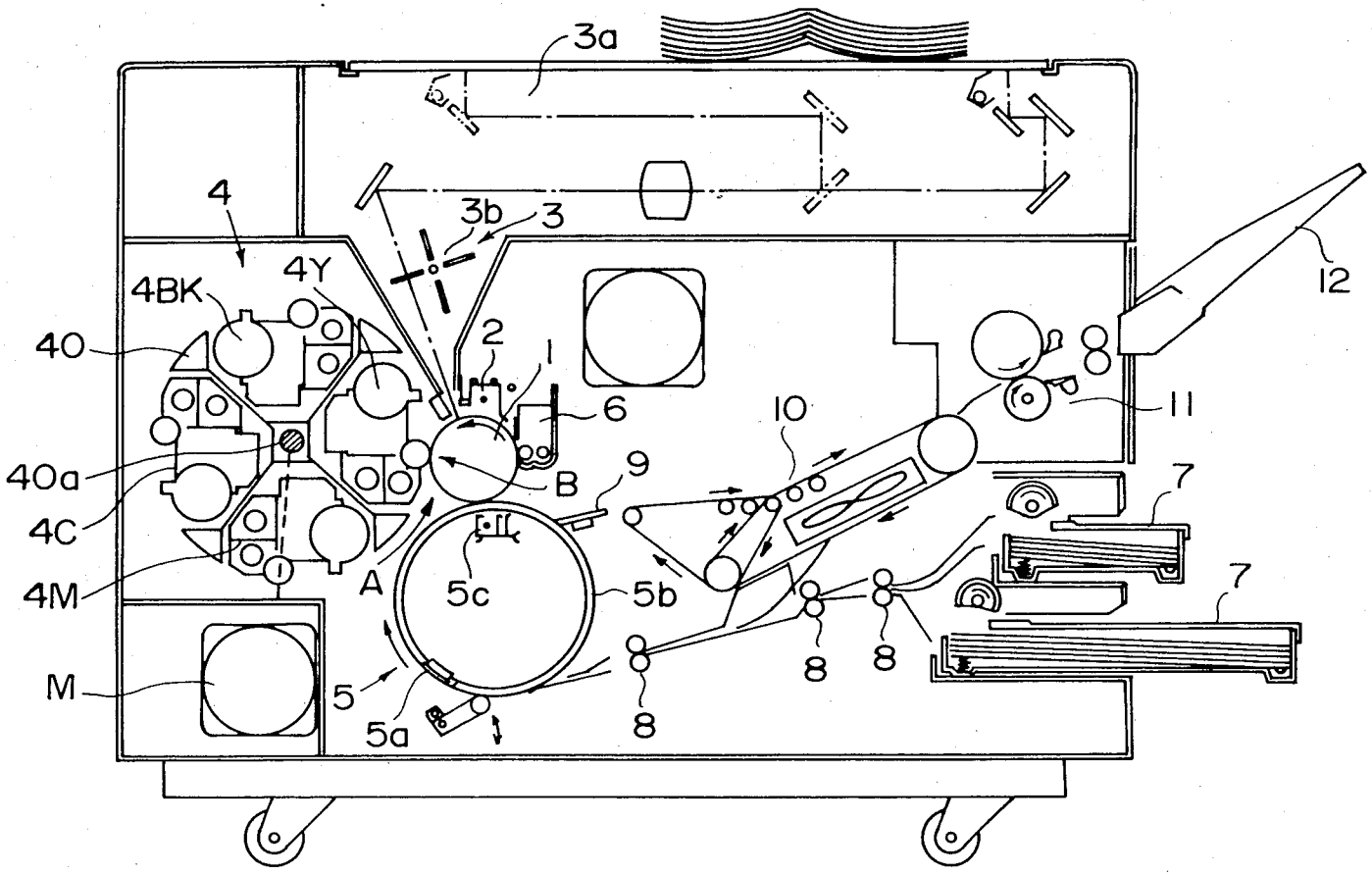
FIG. 1 is a cross-sectional view of a color electrophotographic copying apparatus to which the present invention is applicable.

Referring to FIG. 1, there is shown a color electrophotographic copying apparatus as an example of a color image forming apparatus to which the present invention is applicable.

The apparatus in this Figure comprises a photosensitive drum 1 as an image bearing member which is rotatable in a direction shown by an arrow. Around the photosensitive drum 1, there are disposed a charger 2, an image exposure optical system 3, a developer assembly 4, a transfer station 5 and a cleaning means 6. The optical system 3 includes an original scanning means 3*a* and a color-separating filters 3*b*. The photosensitive drum 1 is uniformly charged by a corona discharger 2 and then exposed to a color-separated light image through an optical system 3. By this exposure to the light image, a latent image is formed on the photosensitive drum 1. The developer assembly 4 comprises a yellow toner developing device 4Y, a magenta toner developing device 4M, a cyan toner developing device 4C and a black toner developing device 4BK. Those developing devices 4Y, 4M, 4C and 4BK are detachably mounted on a supporting member or turret 40. The supporting member 40 is driven by a motor M to rotate about a shaft 40*a* in the direction shown by an arrow A. By the rotation of the supporting member 40, the above-described developing devices 4Y, 4M, 4C and 4BK revolve so that the desired one of the developing devices is moved to the developing station B. Here, the revolution of the developing devices may be in the form of a circular movement, an elliptical movement or another endless movement. In this specification, the circular movement only is taken for the sake of simplicity of explanation. Each of the developing devices is provided with a known developing roller which carries a developing agent and which supplies it to the photosensitive drum to perform the developing operation. Each of the developing devices may have the structure as shown in the Japanese Patent Application Publication No. 20579/1980 filed by the assignee of this application.

The image transfer station 5 includes a transfer drum 5*b* having a known gripper 5*a* and a transfer charger 5*c* in the drum 5*b*. A transfer material is supplied out of a cassette 7 by a transporting roller 8 to the transfer drum 5*b*, where the transfer material is gripped by the gripper 5*a* and is wound around the transfer drum 5*b*. A toner image provided by developing the latent image on the photosensitive drum is transferrred to the transfer material supported on the transfer drum 5*b* by the transfer charger 5*c*, and the transferring operation is repeated onto the same transfer material a plurality of times. Thus, a full-color image can be formed on the transfer material in accordance with the original image by repeating the steps each comprising forming a color-separated latent image of the original on the photosensitive drum; developing the latent image with a predetermined developer; and transferring the developed image onto the transfer material.

The transfer material which has been subjected to the image transfer operations is separated from the transfer drum 5*b* by separating means 9 and then transported to an image fixing device 11 by a transporting belt 10.

There, the image is fixed, and then the transfer material is discharged out of the apparatus to a tray 12.

Figure 2:
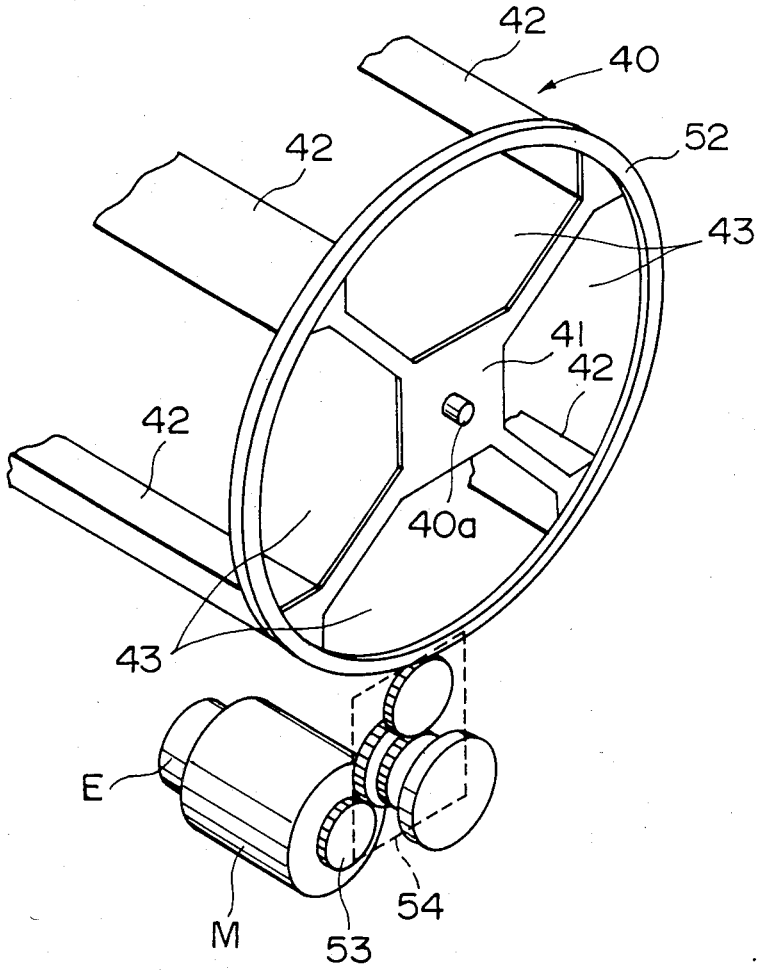
FIG. 2 is a perspective view illustrating the driving mechanism of the developing devices.

FIG. 2 is a perspective view of the driving mechanism for the developer assembly 4 according to the embodiment of the present invention. The supporting member 40 comprises a rear end plate 41, an unshown front end plate, supporting bars 42 fixed therebetween and a driving shaft 40*a*. The developing devices are supported in the supporting positions indicated by a reference numeral 43, respectively. Around the rear end plate 41, a gear 52 is formed or mounted for driving the supporting member 40. The driving force is transmitted from the motor M through the reduction transmission unit 54 which is engaged with the gear 53 on the output shaft of the motor M. The reduction unit 54 provides a required reduction of speed. The reduction unit 54 is also engaged with the gear 52 of the rear end plate 41. A rotary encoder E is provided so as to be rotated in synchronism with the rotation of the motor M. In this example, the rotary encoder E is used to detect substantially the moving speed of the developing devices on the basis of the number of pulse signals per unit time generated by the rotary encoder E. The amount of revolution of the motor is substantially detected as an integration of the number of the pulse signals, so that the position of the developing devices is determined. In place of the rotary encoder E, another detecting means is usable, such as a potentiometer using an electric resistance and a tachogenerator. Of these, the potentiometer can directly detect the position, while the tachogenerator detects the speed. It is possible to use both detectors for detecting the position and the detector for detecting the speed.

Figure 3:
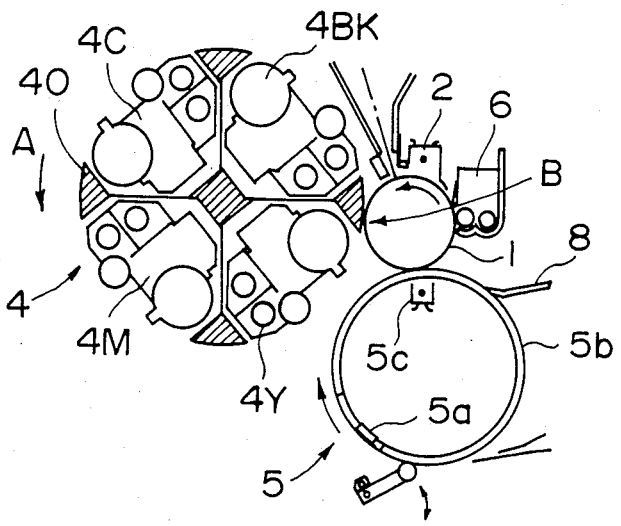
FIG. 3 is a cross-sectional view of a part of the image forming apparatus wherein the developing device is located at its home position.

As shown in FIG. 3, the home position of the developer assembly 4 in this embodiment is the position where the developing device 4Y is 45 degrees away from the developing station B (the reference position, that is, zero degrees) in the clockwise direction. After completion of the color image forming operation, the developer assembly 4 stops at the home position shown in FIG. 3 to prepare for the next image forming operation.

The description of the relation between the selection of the color modes and the amount of rotation (angle) of the developing assembly appears in the following Table 1.

TABLE 1

| | COLOR MODES | AMOUNT OF ROTATION |
|---|---|---|
| 1 | monochromatic mode Y | 45°–315° |
| 2 | monochromatic mode M | 135°–225° |
| 3 | monochromatic mode C | 225°–135° |
| 4 | monochromatic mode BK | 315°–45° |
| 5 | two color mode Y-M | 45°–90°–225° |
| 6 | two color mode Y-C | 45°–180°–135° |
| 7 | two color mode Y-BK | 45°–270°–45° |
| 8 | two color mode M-C | 135°–90°–135° |
| 9 | two color mode M-BK | 135°–180°–45° |
| 10 | two color mode C-BK | 225°–90°–45° |
| 11 | three color mode Y-M-C | 45°–90°–90°–135° |
| 12 | four color mode Y-M-C-BK | 45°–90°–90°–90°–45° |

The apparatus according to this embodiment is operable in three monochromatic modes, six two-color modes, one three-full-color mode and one four-full-color modes, as shown in Table 1. In accordance with the selection from the above modes, the revolution sequence of the supporting member 40 is selected. For example, when the three-full-color mode is selected, the developer assembly 4 is rotated in the direction of the arrow A from the home position shown in FIG. 2 by the angle of 45 degrees so as to set the yellow developing device 4Y to the developing station. After the image is developed with the yellow developer, the developer assembly 40 is rotated by 90 degrees to set the magenta developing device 4M to the developing station, and the developing operation is effected with the magenta toner or developer. Then, the developer assembly 4 is rotated further by 90 degrees to set the cyan developing device 4C at the developing station, and the developing operation is effected with the cyan toner. Thereafter, the developer assembly 4 is rotated by 135 degrees to restore the developer assembly 4 and therefore the developing devices to the home position.

In Table 1, the amount of rotation is indicated as the rotational angle from the home position to the development performing position, from the development performing position to the next development performing position, . . . or from the development performing position back to the home position. As will be understood from the Table, the amount of rotation of the developer assembly, and therefore, the developing devices is one of seven angles, i.e., 45 degrees, 90 degrees, 135 degrees, 180 degrees, 225 degrees, 270 degrees and 315 degrees. The description will be made as to the scheme of movement of the developer assembly in this embodiment.

Figure 4:
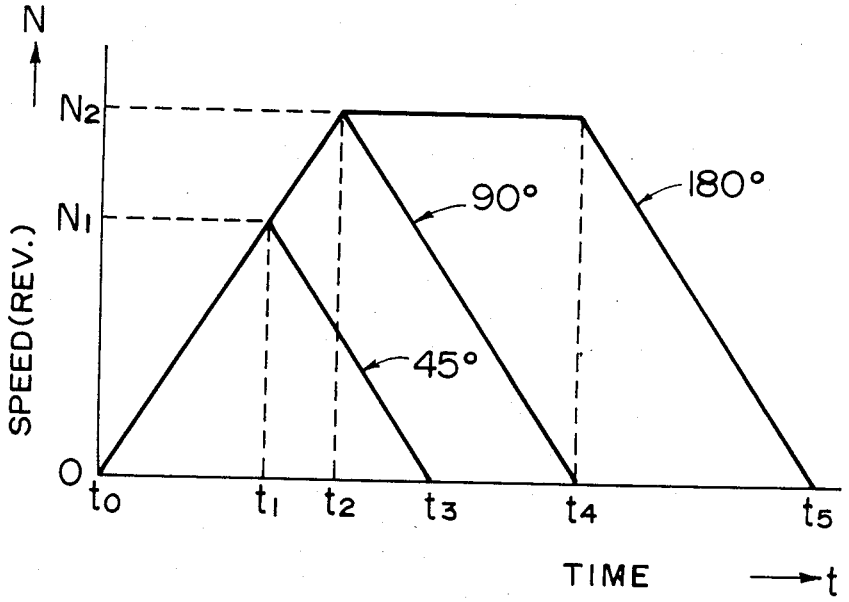
FIG. 4 is a graph showing a change of the speed of the developing device with time in accordance with an embodiment of the present invention.

FIG. 4 shows the interrelation between the speed N and the time t.

Figure 5:
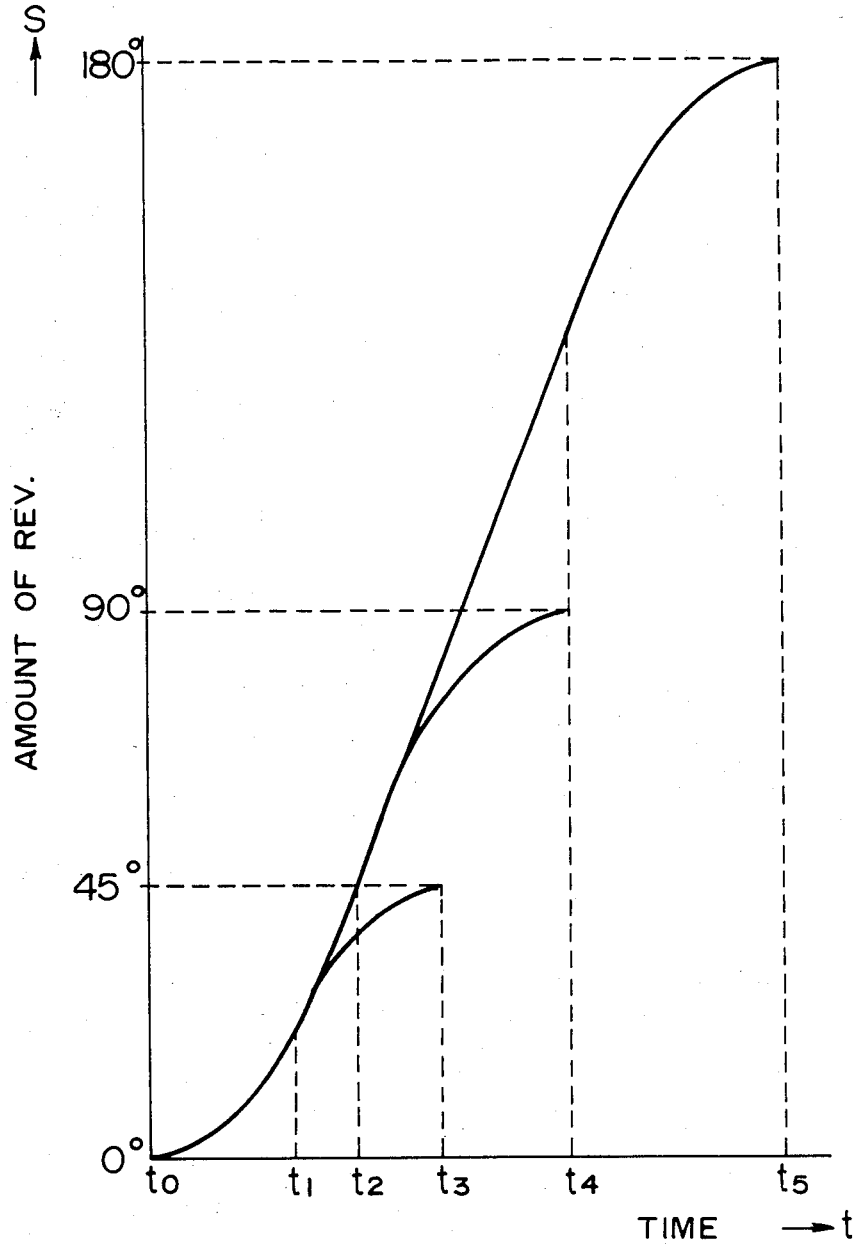
FIG. 5 is a graph showing an amount of revolution with time in accordance with the embodiment of the present invention.

FIG. 5 shows the interrelation between the amount of revolution S and the time t. The speed N is indicated as the rotational speed of the driving motor M equivalent to the rotational speed of the supporting member 40. The description will be made as to the rotation of 45 degree, 90 degrees and 180 degrees of the developer assembly as an example. When it is rotated through 90 degrees, the developer assembly 40 rotates at a constant acceleration (a constant angular acceleration speed) during the period of time $t_0$–$t_2$. After the rotational speed reaches the level of N2 at the time of $t_2$, it decelerates to the rotational speed of 0 at the time $t_4$. Thus, the developer assembly 4 rotates through 90 degrees from time $t_0$ to time $t_4$.

In the case of 45 degrees, it accelerates during the time from time $t_0$ to time $t_1$ similarly to the case of 90 degrees, but it decelerates after the speed reaches N1, and then it stops at time $t_3$. Thus, the developer assembly 4 rotates through 45 degrees from time $t_0$ to $t_3$. In the case of 180 degrees, the developer assembly 40 is accelerated from time $t_0$ to $t_2$ similarly to the case of 90 degrees rotation. After the rotational speed reaches N2, it rotates at a constant rotational speed from time $t_2$ to time $t_4$, and thereafter, it is decelerated and is stopped at time $t_5$. Thus, the developer assembly rotates through 180 degrees from time $t_0$ to time $t_5$.

FIG. 5 shows the amount of revolution or rotation (angle) of the developer assembly 4, and therefore, the position of the developing devices when the developer assembly 4 is rotated in accordance with the above described scheme.

In consideration of the nature of the rotation through 45 degrees, 90 degrees and 180 degrees, the modes of acceleration are all the same in those cases, and the deceleration modes are also all the same in the three cases, so that a single mode is sufficient for each acceleration and deceleration, irrespective of the amount of rotation. In the case of 180 degrees rotation, what is required additionally is only the constant speed mode between the acceleration mode and the deceleration mode. In any case of more than 90 degrees rotation, for example, 135 degrees, 225 degrees, 270 degrees and 315 degrees, it is sufficient if a constant speed mode is added in accordance with the required amount of rotation, and therefore the scheme of movement can be determined in accordance with any desired amount of rotation.

Accordingly, what is needed to meet the above-described seven kinds of rotational amounts is the combination among the acceleration mode for acceleration, a constant speed mode for the constant speed and a deceleration mode for deceleration. The data for the respective amounts of rotation which are combinations of the above-described modes are previously stored in ROM of the computer for controlling the motor M, and the corresponding data are read out of the ROM in accordance with the selection of the color mode to control the operation of the developer assembly 4.

The change in the amount of rotation S with respect to time may be stored in the ROM as data. The actual position detected after movement may be compared with the data to obtain the offset. The motor output is controlled so as to correct the offset. Thus, the developing devices can be moved correctly to a target in accordance with a target movement scheme.

Figure 6:
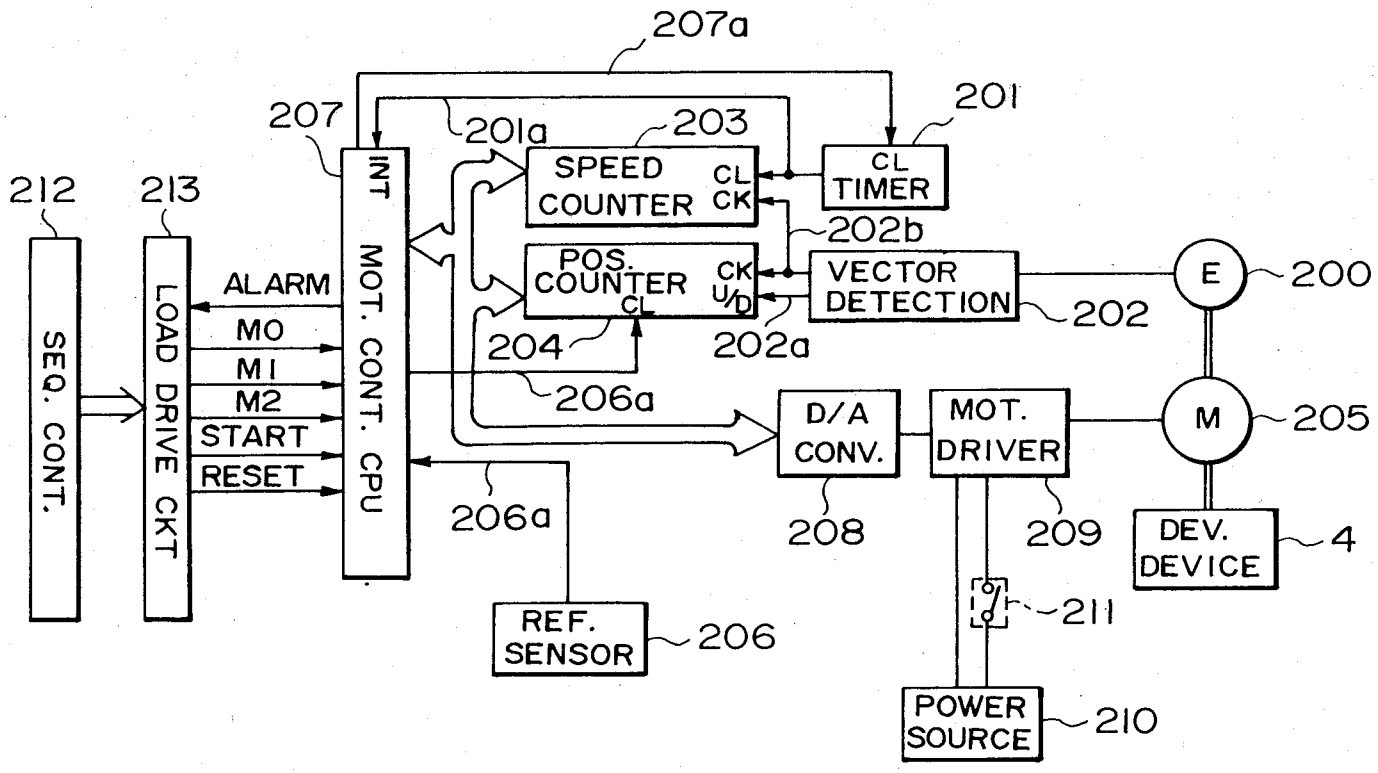
FIG. 6 a block diagram showing a control of operation.

FIG. 6 is a block diagram for the control of the motor M. In this embodiment, a speed counter 203 counts the number of pulses, per constant unit time set by a timer 201, produced by the rotary encoder 200 (indicated by the reference E in FIG. 2). A position counter 204 integrates the pulse signals produced by the rotary encoder 200 to detect the amount of rotation of the motor 205.

The output of the encoder 200 has two phases, A phase and B phase. When the developer assembly 4 rotates in the direction shown by the arrow A in FIG. 1 by the motor 205 which is a forward rotation of the motor, the A phase output is produced by the encoder 200 as a leading output. When, on the other hand, the motor 205 rotates in the opposite, that is, the backward direction, the B phase output is produced by the encoder 200 as a leading output. Those pulse signals are produced, with the aid of a vector detector 202 which can detect the difference therebetween, as direction data 202*a* representing the direction of rotation of the motor and as rotational signals 202*b* representing the encoder signals without the direction of rotation. The rotational signals 202*b* are transmitted to the above described speed counter 203 and to the position counter 204 as the reference signals for the respective counters. The position counter 204 is up and down counter so that it counts up and down in accordance with the directional data 202*a*. In this example, it counts up when the motor rotates in the forward direction and counts down when it rotates in the backward direction. The pulse signals are integrated to determine how far the developer assembly 4 travels by the rotation of the motor M. The position counter 204 is reset to zero in response to a clearing signal 206*a* produced by a reference sensor 206 which is disposed corresponding to the home position of the developer assembly 4.

The speed counter 203 counts the rotational signals 202*b* of the motor and is cleared by an external timer 201.

The external timer 201 is connected to an interruption contacts of a one-chip CPU 207 for controlling the motor. The CPU 207 is effective to set and reset the timer 201 by a control signal 207*a*.

The above-described speed counter 203 and the position counter 204 are connected to I/O port of the CPU 207 so that the count data is read into the CPU 207.

The CPU 207 processes the data in accordance with a predetermined program, and the results thereof are outputted to a digital/analog converter 208 which is effective to control the motor driver 209 in accordance with the result so as to control the motor 205, accordingly.

The motor driver 209 is supplied with the electric power through a door switch 211 which is mounted on a front door of the apparatus openable upon mounting thereto or demounting therefrom the developing devices. Thus, when the developing device or devices are loaded into the apparatus or when the developing device or devices are interchanged with another one, the power supply is shut for the sake of safety by opening the switch 211 to disconnect from the power source 210.

The main part of the image forming apparatus is provided with a sequence controller 211 which governs the overall control of the apparatus, and which produces through a load drive circuit 213 an output of rotational mode signal to the motor control CPU 207 in accordance with the respective amounts of rotation. The amount of rotation are determined depending upon the above-described selection of color modes. The rotational mode signal is a 3 bit signal M0, M1 and M2 which corresponds to the respective amounts of rotation in the manner shown in Table 2 below.

TABLE 2

| NO. | AMOUNT OF ROTATION (angle) | ROTATIONAL MODE SIGNALS M0 | M1 | M2 |
|---|---|---|---|---|
| 0 | 0° | 0 | 0 | 0 |
| 1 | 45° | 0 | 0 | 1 |
| 2 | 90° | 0 | 1 | 0 |
| 3 | 135° | 0 | 1 | 1 |
| 4 | 180° | 1 | 0 | 0 |
| 5 | 225° | 1 | 0 | 1 |
| 6 | 270° | 1 | 1 | 0 |
| 7 | 315° | 1 | 1 | 1 |

Figure 7:
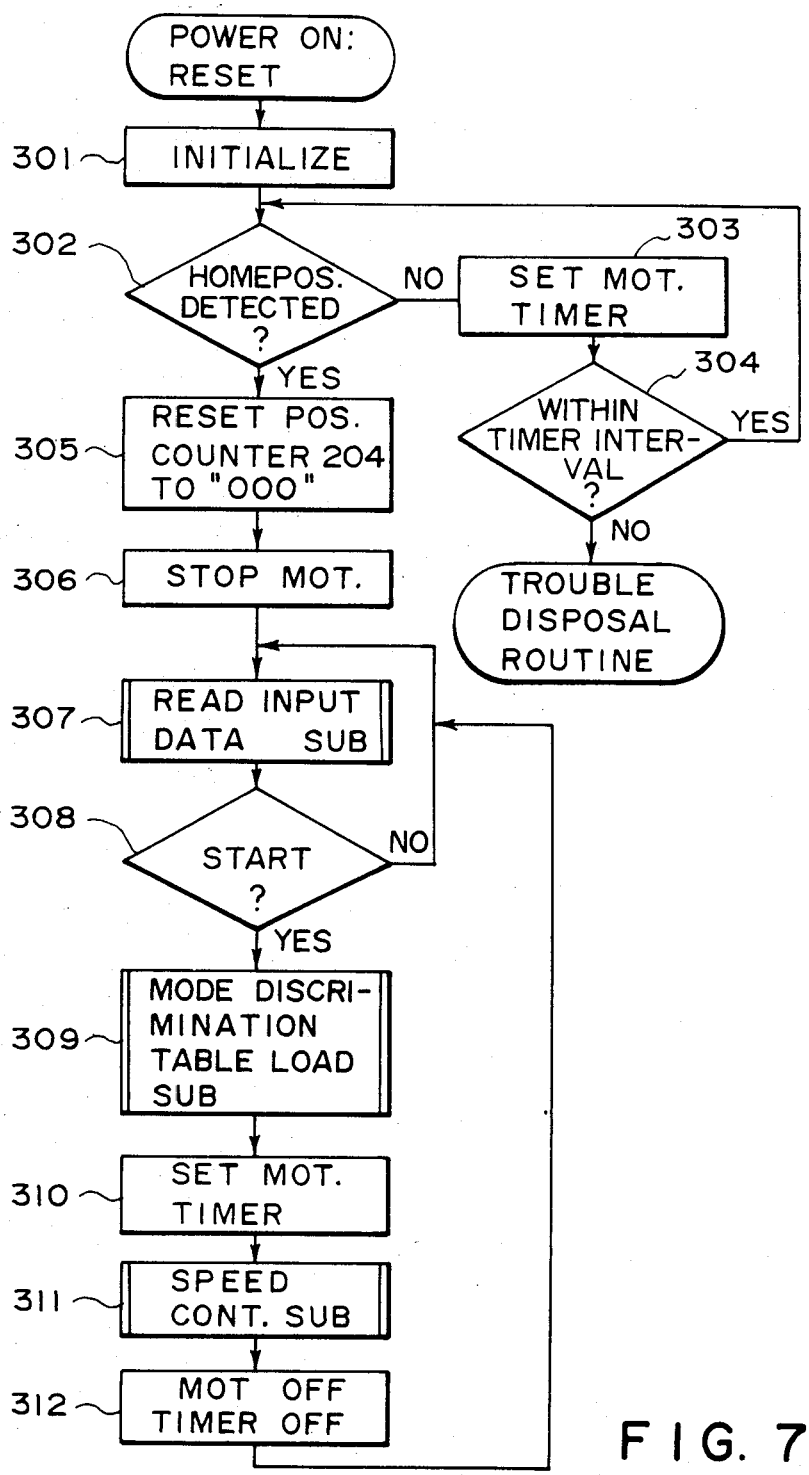
FIGS. 7 and 8 are flow charts illustrating the control.

The operation in this embodiment will now be described in conjunction with the flow chart shown in FIG. 7.

When the main switch of the apparatus is closed, a resetting signal is applied to the motor control CPU 207 to effect initial setting operations within the CPU 207, RAM I/O port at step 301. Then, at step 302, the discrimination is made as to whether or not the developer assembly 4 is at the home position on the basis of the signal produced by the sensor 206. If not, a predetermined timer is set, and the motor is actuated to rotate the developer assembly 4 at step 303. When the developer assembly 4 comes to the home position within the timer interval, the sequence returns to the step 302. If the developer assembly 4 does not come to the home position after the elapse of the timer period, the sequence goes to a trouble disposal routine. The discrimination for this is made at step 304. In the trouble disposal routine, the motor is deenergized, and an alarm signal is produced to the load drive circuit 213 of the sequence controller 212 to produce the warning.

Upon the detection of the home position of the developer assembly 4, the motor control CPU 207 resets to "000" the position counter 204 in response to the signal from the sensor 206 at step 305. And, the motor is stopped to stop the developer assembly 4, and therefore, the developing devices carries thereon at the home position at step 306.

Then, the input port signals of the CPU 207 are processed at step 307. Then, at step 308, the discrimination is made as to whether there is a start signal from the drive circuit 213 or not. If not, the sequence returns to the step 307. If so, the rotational mode signal is received from the input port, and in response to the rotational mode, the preset speed scheme is read out of the ROM of the CPU 207 and is stored in the RAM. At step 309, the scheme data in the RAM are sequentially read in by the interruption of the timer 201 at constant intervals to set the target values of the speed control.

Next, the target values are loaded actually to operate the motor, and the timer 201 is enabled at step 310. Thus, a signal is inputted to the interruption contact of the CPU 207. The speed control is executed at step 311.

Figure 8:
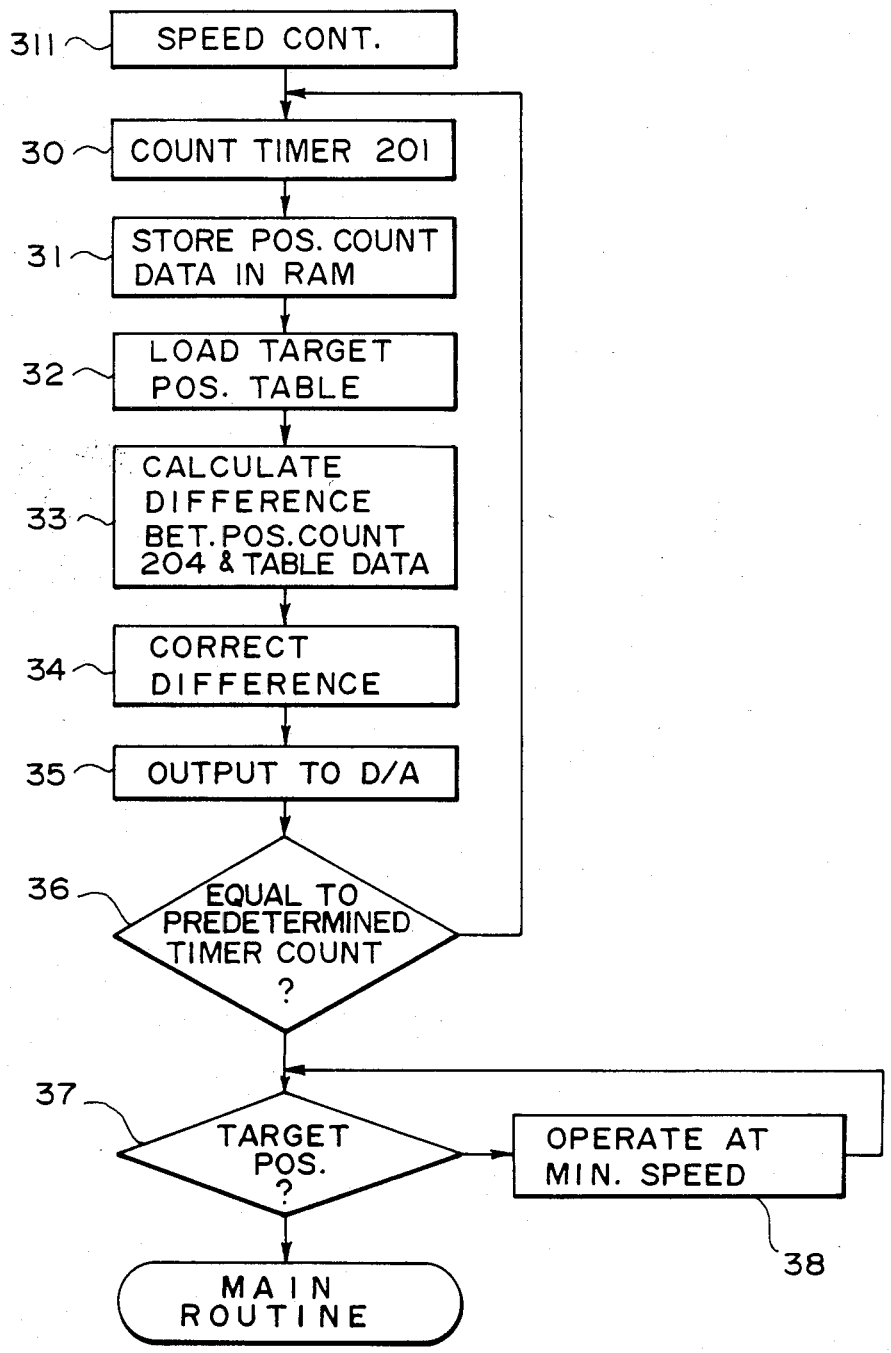

A subroutine for the speed control will be described in conjunction with FIG. 8.

When the signal is inputted to the interruption contact of the CPU 207 by the timer 201, the CPU 207 counts the signal at step 30. At the time when the CPU 207 is interrupted, the data of the position counter 204 is stored in the RAM at step 31.

At step 32, a target position scheme is loaded into a register of the CPU 207 on the basis of the data of the count obtained at the step 31. The position scheme has been stored in various ROMs as the changes of amount of rotation shown in FIG. 5 during divided short periods of time obtained by the basic clockpulses of the timer 201. A plurality of such schemes have been stored corresponding to the rotational modes. Of these schemes, the scheme corresponding to the desired rotational mode is loaded into the RAM. For example, when the rotational angle of 90 degrees corresponds to 4000 pulses of the encoder, and when the developer assembly 4 is desired to move through that angle in 0.6 second, the data is obtained by dividing into 64 segments with the timer 201 interval being 10 msec. When the clock count of the timer 201 is 00H (hexadecimal number), the target position of 4 pulses is stored in the RAM; when it is 01H, 12 pulses are stored in the RAM. The target position scheme has been preset at step 310 so as to align the timer count and the address of the RAM.

Then, the difference is determined between the value of the target position scheme in the register of the CPU 207 and the count of the position counter 207 representing the actual amount of rotation. Here, the initial count is 00H, and the target position value is 0004H. Since the position counter 204 has been cleared at step 310, the difference is 0004H so that the motor is required to rotate the developer assembly 4 in the forward direction at the speed of 0004H at step 33.

The analog value outputted from the D/A converter 208 has 256 steps, of which more than 128 is positive, while less than 128 negative. Therefore, when the speed is 0004H, the direction is positive so that it is necessary to add 008FH to the difference data, which results in 0093H. The result is transmitted to the D/A converter 208, and the motor 205 is controlled in accordance with the result by the motor driver 209 at steps 34 and 35.

Subsequently, at step 36, the discrimination is made as to whether or not the timer count reaches to a predetermined count. This is because the number in the scheme is limited. If it exists, the sequence goes back to the step 30. If not, the discrimination is made whether or not the developer assembly 4 takes the target position or not at step 37. If not, the difference is calculated and it is moved at the minimum speed. When it comes to the target position, the sequence returns to the main routine.

At the time when the difference between the value of the table at the actual count of the position counter reaches 0, the motor 205 is deenergized, and the timer 201 is activated, and the sequence returns to the step 307, at step 312.

As described above, the ROM stores the scheme or table constituted by the data corresponding to the constant unit time intervals such that the movement scheme shown in FIG. 5 is obtained. The thus set target data are compared with the data obtained from the position counter. The motor is controlled to correct the deviation or offset therebetween. Therefore, the developer assembly 4 can be moved in accordance with the target movement scheme.

A pluralty of such position schemes are provided in the ROM in accordance with the amount of rotation required. The desired scheme is read out of the ROM in response to the rotational mode desired.

In this embodiment, as will be appreciated from FIG. 4, the rotational speed of the developer assembly 4 is gradually increased at the time of start, while it is gradually decreased at the time of stoppage, whereby the shock to the developer assembly 4 is eased.

Figure 9:
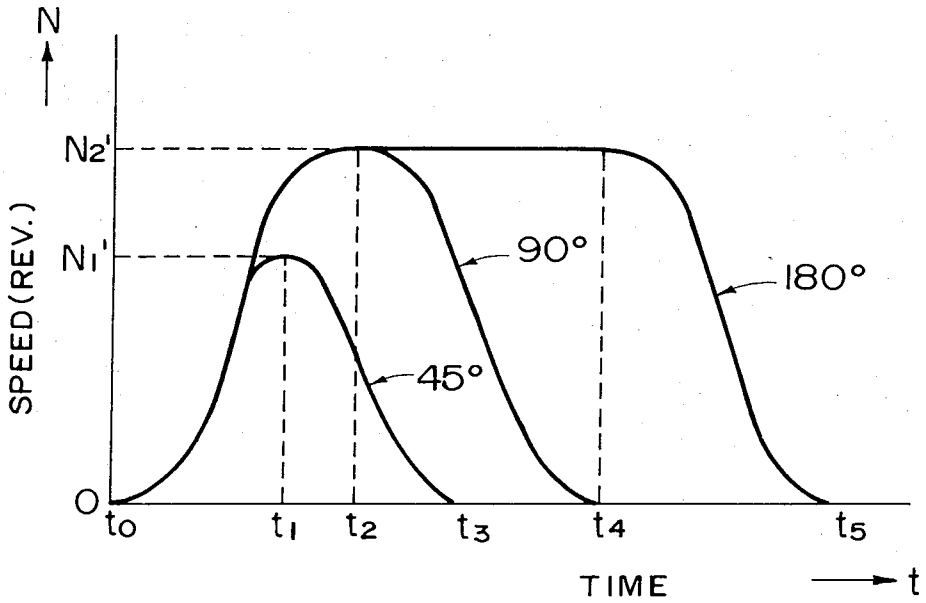
FIG. 9 a graph showing a change of the speed according to another embodiment of the present invention.

FIG. 9 shows a speed scheme according to another embodiment of the present invention. In the foregoing embodiment described with FIG. 4 the movement is constant angular acceleration and deceleration in the acceleration range and the deceleration range. In the embodiment of FIG. 9, the acceleration or deceleration is lower at the time of start and stoppage and at the time of reaching the constant speed, whereby the shock to the developer assembly 4, and therefore, to the developing devices can be further decreased since smoother start and smoother stoppage are provided. This is advantageous in that it can further avoid the possible shock and the resulting toner scattering. In order to obtain this speed scheme to drive the developer assembly 4, the reference data in the speed scheme or table are stored in the ROM in accordance with the nature of FIG. 9, which will be understood by ordinary skilled in the art when referring to the above-described embodiment.

The speed of the developer assembly and the position thereof (the amount of movement thereof) may be detected not by directly detecting the position of the developer assembly but by detecting the position or state of the supporting member for the developer assembly or an element or elements in the driving mechanism. The present invention is intended to cover such a structure not directly detecting the position of the developer assembly or the developing devices.

As described in the foregoing, according to the present invention, the required developing device is moved to the predetermined position correctly and at a high speed in accordance with the predetermined movement scheme. Furthermore, the movement can start and end smoothly.

While the invention has been described with reference to the structures disclosed herein, it is not confined to the details set forth and this application is intended to cover such modifications or changes as may come within the purposes of the improvements or the scope of the following claims.

What is claimed is:

1. A color image forming apparatus wherein a plurality of developing units each containing a selected color of developer are supported on a supporting member, and a desired one of the plurality of the developing units is revolved to a predetermined developing station to develop a latent image corresponding to the desired one to provide a color image, said apparatus comprising:

driving means for revolving the developing unit;

detecting means for detecting at least one of a speed of revolution of the developing unit and a position of the developing unit; and control means for controlling an output of said driving means, said control means comparing a datum provided by said detecting means with a datum of a predetermined target movement scheme and controlling the output of said driving means to correct the difference therebetween.

2. An apparatus according to claim 1, wherein said target movement scheme includes a data table of target positions corresponding to constant time increments.

3. An apparatus according to claim 2, wherein a plurality of such position data tables are provided corresponding to amounts of revolution of the developing units.

4. An apparatus according to claim 1, wherein said movement scheme includes an acceleration mode wherein the developing unit is accelerated, a constant speed mode wherein the developing unit is moved at a costant speed and a deceleration mode wherein the developing unit is decelerated, and wherein selection can be made among the three modes.

5. An apparatus according to claim 1, wherein the amount of rotation is determined in accordance with selection of a color image formation mode.

* * * * *

UNITED STATES PATENT AND TRADEMARK OFFICE

CERTIFICATE OF CORRECTION

PATENT NO. : 4,615,612

DATED : October 7, 1986

INVENTOR(S) : AKIO OHNO, ET AL.

It is certified that error appears in the above-identified patent and that said Letters Patent is hereby corrected as shown below:

COLUMN 2

Line 18, "a color-" should read --color- --.

COLUMN 3

Line 33, "the detector" should be deleted.

COLUMN 4

Line 36, "40" should read --4--.
Line 48, "40" should read --4--.

COLUMN 6

Line 26, "amount" should read --amounts--.

COLUMN 7

Line 2, "carries" should --carried--.
LIne 57, "is" should read --are--.

UNITED STATES PATENT AND TRADEMARK OFFICE

CERTIFICATE OF CORRECTION

PATENT NO. : 4,615,612

DATED : October 7, 1986

INVENTOR(S) : AKIO OHNO, ET AL.

It is certified that error appears in the above-identified patent and that said Letters Patent is hereby corrected as shown below:

COLUMN 7

Line 58, "negative" should read --are negative--.

COLUMN 8

Line 20, "pluralty" should read --plurality--.
Line 31, "with" should read --in--.
Line 45 "ordinary" should read --those ordinarily--.

Signed and Sealed this

Twenty-first Day of April, 1987

*Attest:*

DONALD J. QUIGG

*Attesting Officer*

*Commissioner of Patents and Trademarks*